US008223084B2

(12) United States Patent
Tani et al.

(10) Patent No.: US 8,223,084 B2
(45) Date of Patent: Jul. 17, 2012

(54) ANTENNA ELEMENT

(75) Inventors: Kazuya Tani, Osaka (JP); Yoshio Koyanagi, Yokohama (JP)

(73) Assignee: Panasonic Corporation, Osaka (JP)

( * ) Notice: Subject to any disclaimer, the term of this patent is extended or adjusted under 35 U.S.C. 154(b) by 345 days.

(21) Appl. No.: 12/676,008

(22) PCT Filed: Sep. 6, 2007

(86) PCT No.: PCT/JP2007/067433

§ 371 (c)(1),
(2), (4) Date: Mar. 2, 2010

(87) PCT Pub. No.: WO2009/031229

PCT Pub. Date: Mar. 12, 2009

(65) Prior Publication Data

US 2010/0171676 A1 Jul. 8, 2010

(51) Int. Cl.
*H01Q 9/26* (2006.01)

(52) U.S. Cl. ..... 343/803

(58) Field of Classification Search ..... 343/803, 343/802, 804, 806, 820, 821

See application file for complete search history.

(56) References Cited

U.S. PATENT DOCUMENTS

| | | | | |
|---|---|---|---|---|
| 5,808,584 | A * | 9/1998 | Skahill | 343/803 |
| 6,285,336 | B1 * | 9/2001 | Zimmerman | 343/803 |
| 6,310,586 | B1 | 10/2001 | Takahashi | |
| 2002/0018021 | A1 | 2/2002 | Koyanagi | |
| 2002/0126052 | A1 | 9/2002 | Boyle | |
| 2003/0160728 | A1 | 8/2003 | Fukushima | |
| 2004/0125031 | A1 | 7/2004 | Jo | |
| 2004/0239564 | A1 | 12/2004 | Sakae | |
| 2005/0119035 | A1 | 6/2005 | Miyano | |
| 2006/0152419 | A1 | 7/2006 | Sato | |

(Continued)

FOREIGN PATENT DOCUMENTS

JP 5327331 A 12/1993

(Continued)

OTHER PUBLICATIONS

International Search Report mailed Oct. 30, 2007, in corresponding International Application No. PCT/JP2007/067433, filed Sep. 6, 2007.

*Primary Examiner* — Hoang V Nguyen
(74) *Attorney, Agent, or Firm* — Seed IP Law Group PLLC

(57) ABSTRACT

It is made possible to realize both miniaturization and a wider band in an antenna element. An antenna element includes a first conductor wire part 11A; a second conductor wire part 11B crossing the first conductor wire part 11A and connected; a third conductor wire part 11C crossing the second conductor wire part 11B and connected, and parallel to the first conductor wire part 11A; a fourth conductor wire part 11D crossing the third conductor wire part 11C and connected; and a first conductor flat plate 12 connected to one or two of the first conductor wire part 11A, the second conductor wire part 11B, the third conductor wire part 11C, and the fourth wire part 11D and disposed in the area surrounded by any three of the first conductor wire part 11A, the second conductor wire part 11B, the third conductor wire part 11C, and the fourth wire part 11D. An end part of the first conductor flat plate 12 is parallel with the first conductor 11A not connected to the first conductor flat plate 12.

10 Claims, 13 Drawing Sheets

U.S. PATENT DOCUMENTS

| | | | |
|---|---|---|---|
| 2006/0208955 | A1 | 9/2006 | Kai |
| 2007/0085751 | A1 | 4/2007 | Kai |

FOREIGN PATENT DOCUMENTS

| | | | |
|---|---|---|---|
| JP | 2001-244723 | A | 9/2001 |
| JP | 2002-043826 | A | 2/2002 |
| JP | 2003-014087 | A | 1/2003 |
| JP | 2003-152417 | A | 5/2003 |
| JP | 2004-007510 | A | 1/2004 |
| JP | 2004-140496 | A | 5/2004 |
| JP | 2004-147327 | A | 5/2004 |
| JP | 2004140815 | A | 5/2004 |
| JP | 2004-172912 | A | 6/2004 |
| JP | 2004-519914 | T | 7/2004 |
| JP | 2004228917 | A | 8/2004 |
| JP | 2005-004061 | A | 1/2005 |
| JP | 2006-196994 | A | 7/2006 |
| JP | 2006-203446 | A | 8/2006 |
| JP | 2006-295879 | A | 10/2006 |
| JP | 2007-116300 | A | 5/2007 |
| WO | 02/075853 | A1 | 9/2002 |

* cited by examiner (A)

(B)

(A)

(B)

(A)

(B)

(A)

(B)

ANTENNA ELEMENT

TECHNICAL FIELD

This invention relates to an antenna element used with mobile wireless communications and in particular to an antenna element that can be incorporated in a small radio device, etc., and has a wideband characteristic.

BACKGROUND ART

In a small radio device, for example, a mobile wireless terminal, etc., higher performance and miniaturization are required and for an antenna, miniaturization for enabling the antenna to be incorporated in a cabinet of a mobile wireless terminal, etc., and a wideband characteristic compatible with various applications are demanded.

As such an antenna, for example, a small wideband antenna described in FIG. 12 is known (for example, refer to Patent Document 1). That is, this small wideband antenna is formed by bending both ends of an element toward a feeding part in a state in which a full-wave loop antenna 101 is brought close to a ground plate 102; a current distribution is small on the ground plate 102 and the effect when the user approaches the antenna is hard to receive and in addition, directional characteristics responsive to an incoming wave can be realized. Numeral 103 in the figure denotes a wireless circuit.

As the antenna described above, for example, an antenna as shown in FIG. 13 is also known (for example, refer to Patent Document 2). That is, in this antenna, preceding portions from left and right about a one-eighth wavelength of a feeding point 202 of a folded dipole antenna 201 of half-wave parallel line with both ends short-circuited are bent vertically and horizontally as bilateral symmetry to form an antenna element 203 of a double folded structure. According to the antenna of the configuration, parameters for determining the antenna structure, particularly spaces s and h and a strip width ratio (w1/w2) are adjusted, whereby impedance matching over a wide band is made possible.

Further, as such an antenna, for example, an antenna as shown in FIG. 14 is also known (for example, refer to Patent Document 3). That is, this antenna is an antenna appropriate for being incorporated in a radio unit where multiple resonances and impedance adjustment are possible. Power is fed into a first antenna 301 of folded monopole type and a second antenna 302 of monopole type with the tip open, a short-circuit part is provided in an intermediate part of the first antenna 301, and the total length of a going path from a feeding point 303 to a fold point and a return path to a ground point 304 is a half-wavelength of resonance frequency. In the antenna, the second antenna 302 is made to branch between the feeding point 303 and the short-circuit part and the whole element length is made to correspond to a quarter-wavelength of resonance frequency; on the other hand, the first antenna element 301 also functions as a stub of the second antenna element 302. Numeral 305 in the figure denotes a board.

Patent Document 1: JP-A-2002-43826
Patent Document 2: JP-A-2004-228917
Patent Document 3: JP-A-2006-196994

DISCLOSURE OF THE INVENTION

Problems to be Solved by the Invention

However, in the antenna described in Patent Document 1, if a passive element is added, the band is narrow. In the antenna described in Patent Document 2, the antenna element is large and therefore, it is also difficult to cover low frequencies. Further, the antenna described in Patent Document 3 involves a problem of a further wider band.

In view of the circumstances described above, it is an object of the invention to provide an antenna element capable of realizing both miniaturization and a wider band.

Means for Solving the Problems

An antenna element of the invention is a part of an antenna element having a fold structure and includes a first conductor; a second conductor crossing the first conductor and connected; a third conductor crossing the second conductor and connected, and parallel to the first conductor; and a first conductor flat plate connected to one or two of the first conductor, the second conductor, and the third conductor and disposed in an area surrounded by the first conductor, the second conductor, and the third conductor.

An antenna element of the invention is a part of an antenna element having a fold structure and includes a first conductor; a second conductor crossing the first conductor and connected; a third conductor crossing the second conductor and connected, and parallel to the first conductor; and a second conductor flat plate connected to any one of the first conductor, the second conductor, and the third conductor and disposed adjacent to an area surrounded by the first conductor, the second conductor, and the third conductor.

An antenna element of the invention is a part of an antenna element having a fold structure and includes a first conductor; a second conductor crossing the first conductor and connected; a third conductor crossing the second conductor and connected, and parallel to the first conductor; a first conductor flat plate connected to one or two of the first conductor, the second conductor, and the third conductor and disposed in an area surrounded by the first conductor, the second conductor, and the third conductor; and a fourth conductor connected to any one of the first conductor, the second conductor, and the third conductor and disposed adjacent to an area surrounded by the first conductor, the second conductor, and the third conductor.

According the configuration, both miniaturization and a wider band of the antenna element can be realized.

ADVANTAGES OF THE INVENTION

According the invention, the antenna element includes a first conductor wire part; a second conductor wire part crossing the first conductor wire part and connected; a third conductor wire part crossing the second conductor wire part and connected, and parallel to the first conductor wire part; and a fourth conductor wire part crossing the third conductor wire part and connected and a first conductor flat plate connected to one or two of the first conductor wire part, the second conductor wire part, the third conductor wire part, and the fourth wire part and disposed in the area surrounded by any three of the first conductor wire part, the second conductor wire part, the third conductor wire part, and the fourth wire part, whereby it is made possible to have a capacitive reactance component and the antenna element capable of realizing both miniaturization and a wider band can be provided.

According the invention, the antenna element includes a first conductor wire part; a second conductor wire part crossing the first conductor wire part and connected; a third conductor wire part crossing the second conductor wire part and connected, and parallel to the first conductor wire part; a fourth conductor wire part crossing the third conductor wire part and connected; and a second conductor flat plate connected to any one of the first conductor wire part, the second conductor wire part, the third conductor wire part, and the fourth wire part and disposed adjacent to the area surrounded by any three of the first conductor wire part, the second conductor wire part, the third conductor wire part, and the fourth wire part, whereby it is made possible to have an inductive reactance component and the antenna element capable of realizing both miniaturization and a wider band can be provided.

The first to fourth conductor wires applied to the folded antenna element can be effectively adopted in the antenna shape, etc., provided by twice bending both tips of a folded dipole antenna like an angular U-shape, for example. Actually, as compared with the conventional antenna dimensions (for example, refer to Patent Document 2), the antenna configuration is used, whereby drastic miniaturization can be realized so that the occupation volume of the antenna element is about one-fifth or less in an equal wideband characteristic.

DESCRIPTION OF REFERENCE NUMERALS

Figure 1:
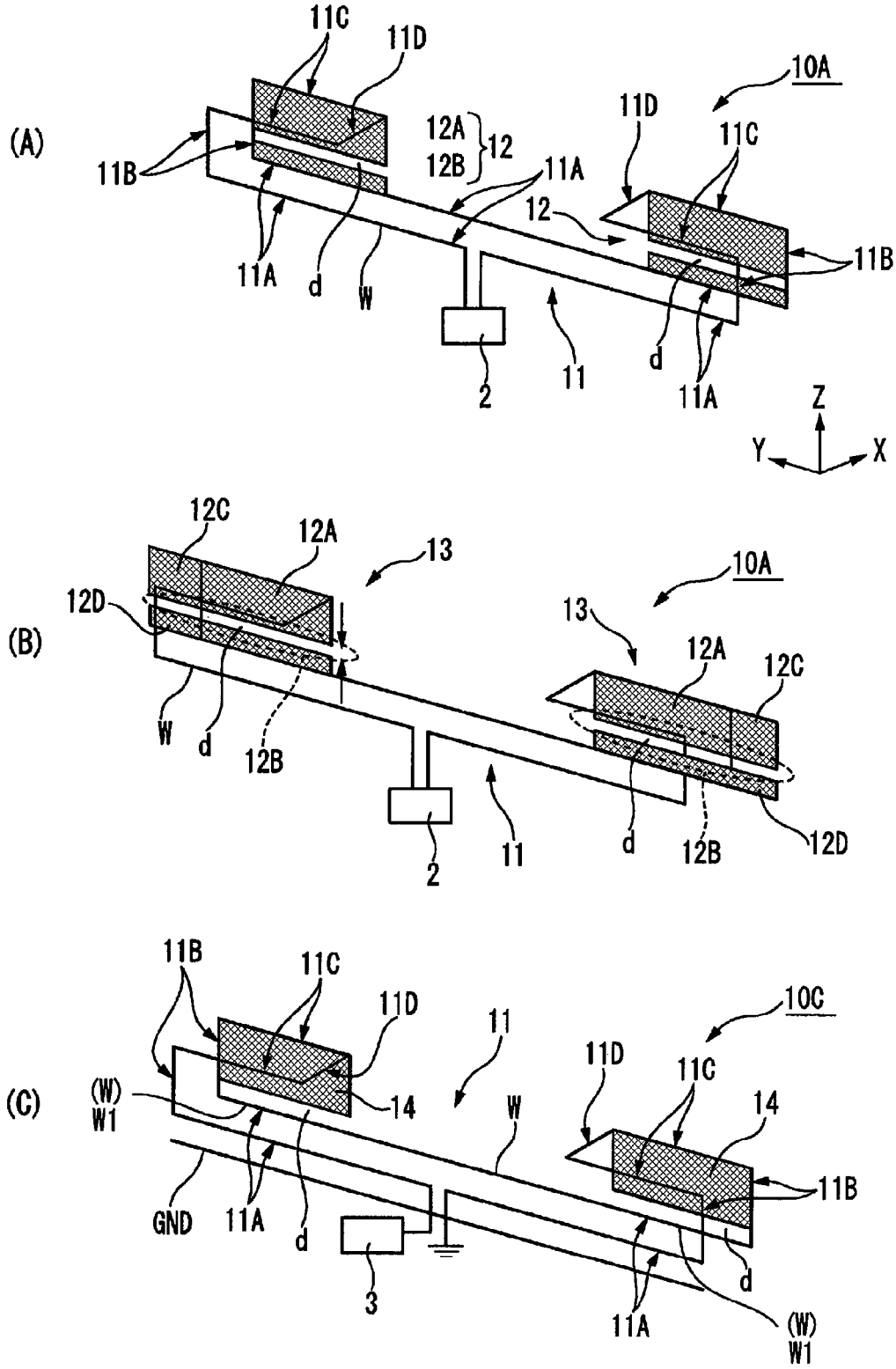
FIG. 1 shows an antenna element according to a first embodiment of the invention; (A) is a drawing to show the schematic configuration of the antenna element; (B) is a configuration drawing to show a modified example; and (C) is a configuration drawing to show another modified example.

10A, 10C, 30A, 30B, 40A, 50A, 50B, 60A Antenna element
11 Folded (dipole) antenna (antenna main body)
11A First conductor wire part
11B Second conductor wire part
11C Third conductor wire part
11D Fourth conductor wire part
12, 14 First conductor flat plate (third conductor flat plate)
12A Main flat plate (main conductor)
12B Sub flat plate (subconductor)
15 Antenna main body
15A-15D First conductor wire part to fourth conductor wire part
2 Balanced feeding section
22 Second conductor flat plate
3 Unbalanced feeding section
61, 62, 63 Second conductor flat plate
61A, 62A, 63A Slot
A, B, C Balanced 2-line portion with one side short-circuited
d Space
$f_0$ Center frequency
M1, M2, M3-M5 Meander
W Core wire (conductor formed of wire rod)
$\lambda_0$ Center wavelength

BEST MODE FOR CARRYING OUT THE INVENTION

Embodiments of the invention will be discussed below in detail with reference to the accompanying drawings.

(First Embodiment)

FIG. 1(A) shows the schematic configuration of an antenna element 10A according to a first embodiment of the invention. This antenna element 10A has a basic configuration of an antenna (FIG. 2(B)) (which will be hereinafter referred to as antenna main body) 11 formed by further bending the main body portion of a folded half-wave (dipole) antenna (FIG. 2(A)) made of a core wire (a conductor formed of a wire rod) W to two. First conductor flat plates (a pair is placed as bilateral symmetry, corresponding to "third conductor flat plates") 12 are provided at a midpoint of the antenna main body 11 to form a space d, whereby a capacitive inductance (C) component is possessed between antenna elements. If installed conductors are constantly spaced from each other, operation is performed usually as a distribution constant where the lower the frequency, the larger the C component.

The core wire W at this time is not limited to a wire rod and can also be formed like a belt with a given thickness in a z axis direction or a y axis direction.

Figure 2:
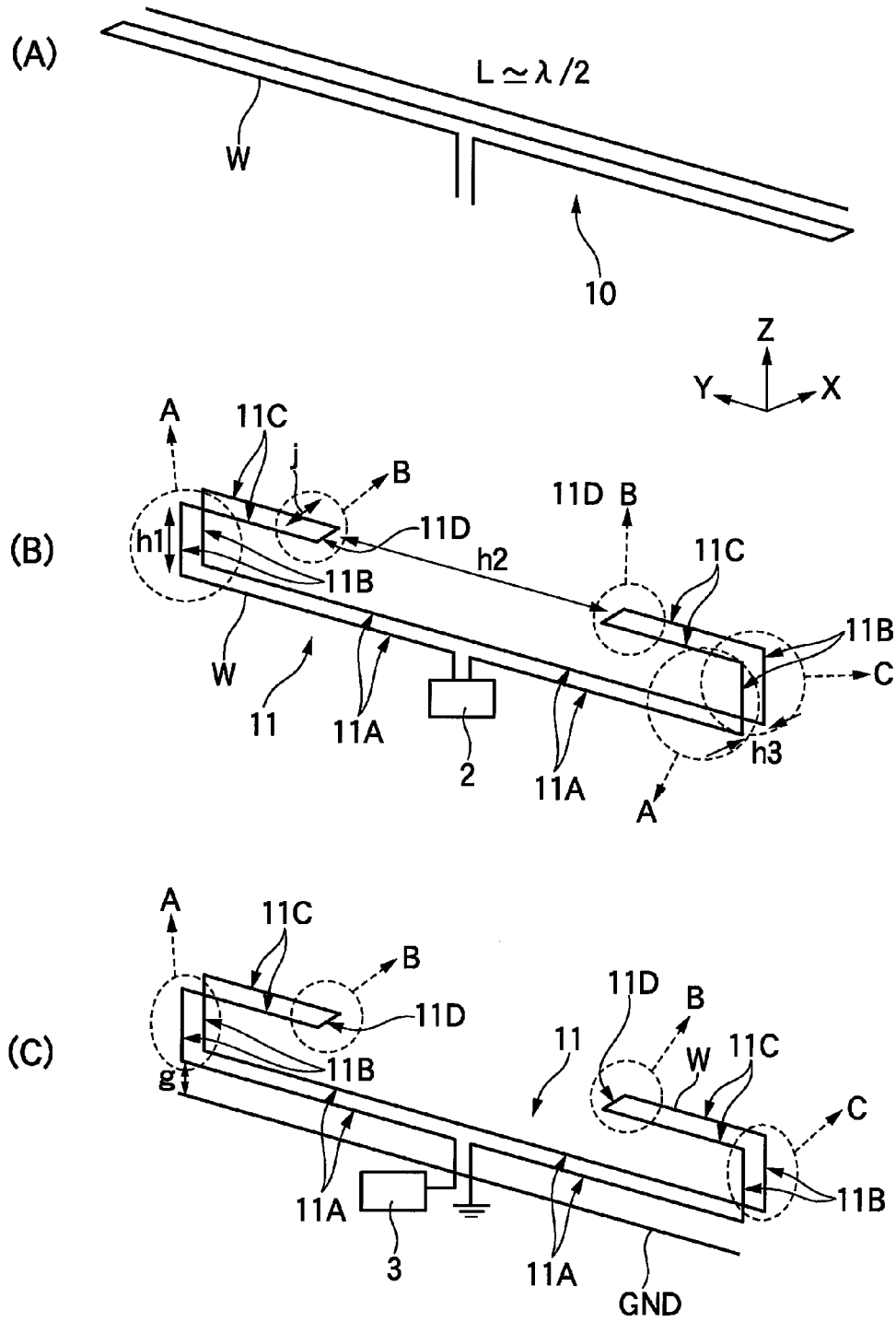
FIG. 2(A) is a drawing to show the original shape of an antenna main body of a basic configuration of the antenna element of the invention; (B) is a schematic representation to show the configuration for balanced feeding of the folded antenna element; and (C) is a schematic representation to show the configuration for unbalanced feeding.

The antenna main body 11 originally is a folded dipole antenna element with a full width L having about a half-wavelength (λ/2) as shown in FIG. 2(A) and is formed by bending both left and right end parts each like a roughly angular U-shape as shown in FIG. 2(B). That is, the antenna main body 11 include a plurality of elements of first conductor wire parts 11A, second conductor wire parts 11B connected crossing the first conductor wire parts 11A, third conductor wire parts 11C parallel to the first conductor wire parts 11A, connected crossing the second conductor wire parts 11B, and a fourth conductor wire part 11D crossing the third conductor wire parts 11C and provided between the third conductor wire parts 11C. Therefore, in the antenna main body 11, three balanced 2-line portions with one side short-circuited surrounded by the core wire W like a roughly angular U-shape are formed left and right (namely, portions of A, B, and C surrounded by the dotted lines).

In the embodiment, the antenna element main body 11 has a bilateral symmetry shape and thus also includes those similar to the first conductor wire parts 11A to the fourth conductor wire part 11D on the opposite side. That is, in the embodiment, the antenna main body has the first conductor wire parts 11A to the fourth conductor wire part 11D in the left half and fifth conductor wire parts 11A to eighth conductor wire part 11D in the right half (however, in FIG. 1(A), the same numerals are given for convenience).

The first conductor flat plate 12 forms a capacitive inductance (C) component and in the embodiment, is provided in one of the area C in FIG. 2(B) and is made up of a main flat plate (main conductor) 12A and a sub flat plate (subconductor) 12B. The first conductor flat plate 12 is formed with a space d sufficiently small relative to operation frequency $f_0$ between the main flat plate (which will be hereinafter also called conductor) 12A and the sub flat plate (which will be hereinafter also called conductor) 12B, so that a distribution constant (C) component can be given to the antennal element 10A.

The main conductor 12A is connected to the second conductor wire part 11B and the third conductor wire part 11C. An end part of the main conductor 12A is parallel with the first conductor wire part 11A not connected to the main conductor 12A.

On the other hand, the subconductor 12B is connected to the first conductor wire part 11A and the second conductor wire part 11B. An end part of the subconductor 12B is parallel with the third conductor wire part 11C not connected to the subconductor 12B.

The first conductor flat plate 12 of the embodiment is installed in the area surrounded by the three parts of the first conductor wire part 11A, the second conductor wire part 11B, and the third conductor wire part 11C, namely, the area C in FIG. 2(B), but may be formed in either the area A or the area B of the balanced 2-line portion with one side short-circuited. The first conductor flat plate of the invention may show a mesh shape as well as the flat plate structure like the first conductor flat plate 12 of the embodiment.

The space d is about 0.01λ (preferably, 0.005 $\lambda_0$ or less when center wavelength $\lambda_0$ relative to the center frequency $f_0$) and the total size of the main flat plate (main conductor) 12A and the sub flat plate (subconductor) 12B has an area wider than the size of the portion of the space d.

The first conductor flat plate 12 may physically be a plane shape having a larger size than the core wire W. Thus, like the antenna element 10A in FIG. 1(A), two conductors (different in length in a Z direction) may be electrically connected to the core wire W or the core wire W may be removed only in the portion and connection to the adjacent core wire portion may be made. In the embodiment, the Z component length of the upper conductor 12A of the two conductors 12A and 12B is made longer; whereas, the Z component length of the lower conductor 12B may be made longer.

As described above, the full length L of the antenna element 10A has a length as much as about one wavelength (λ) and as shown in FIG. 2(B), to perform balanced feeding, both end parts are connected to a balanced feeding section 2 containing a matching circuit. Although the original antenna element length has a length as much as about one wavelength (λ), it is made possible to set the operation frequency low according the configuration wherein capacitive inductance (C) component is provided and thus the substantial antenna length in the antenna configuration is shortened drastically.

In the invention, in addition, for example, as shown in FIG. 2(C), an element half part of folded antenna provided symmetrically may be used and monopole antenna configuration with the full length L having about a quarter-wavelength (λ/4) may be adopted. At this time, one end of the antenna 11 is connected to an unbalanced feeding section 3 and an opposite end is connected to GND. Therefore, in the antenna shape, a wideband characteristic can be provided regardless of the feeding mode of balanced feeding or unbalanced feeding.

In the antenna configuration, miniaturization of a wideband antenna is made possible. Parameters of spaces between antenna elements h1 to h3, antenna element width j, and distance g from GND used for performing impedance adjustment in a wide band in the original antenna shape FIG. 2(B), 2(C) can be used for impedance adjustment of the small wideband antenna. However, it does not directly contribute to miniaturization of the antenna element.

Moreover, according to the embodiment, the space d is about 0.01λ and the conductor 12A, 12B has a wider area than the space d and thus current concentration occurs in the space d and consequently capacitive inductance (C) component can be possessed between the close conductors 12A and 12B. Since the capacitance component can be changed by adjusting the size of the space d, further fine parameter adjustment can be made.

Generally, it is known that a folded antenna operates in composite mode having different operation modes of an unbalanced mode and an unbalanced mode, and it is made possible to configure (unbalanced mode) for performing impedance adjustment by bringing the antenna element close in the antenna element. The antenna realizes a wider band by applying the characteristic adjusting the impedance that the composite mode has.

In the embodiment, the shape of the gap part where the capacitance component is provided seems to be a slot antenna, but the antenna operation is a field radiation source and the antenna differs from a general slot antenna provided with a slot in the vicinity of a feeding point for radiating.

Figure 3:
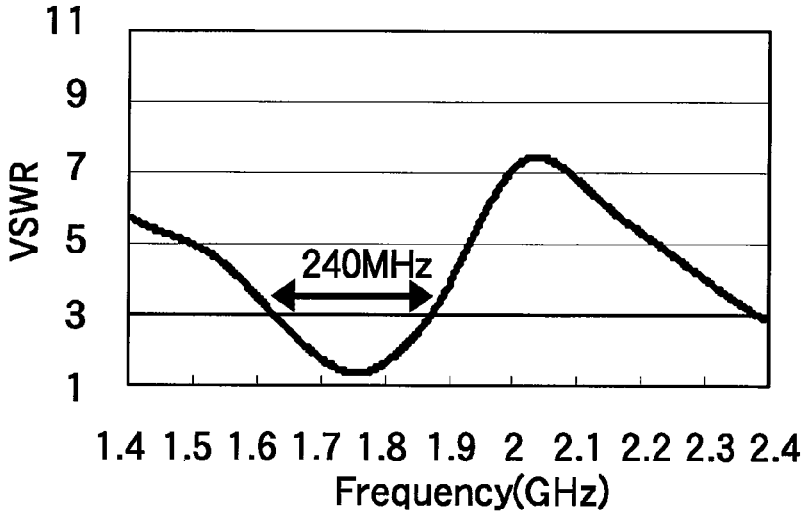
FIG. 3 is a VSWR characteristic drawing of the antenna element according to the first embodiment of the invention; (A) is a VSWR characteristic drawing of the antenna element of the invention; and (B) is a VSWR characteristic drawing of a conventional antenna element of a core wire only.
Figure 3:
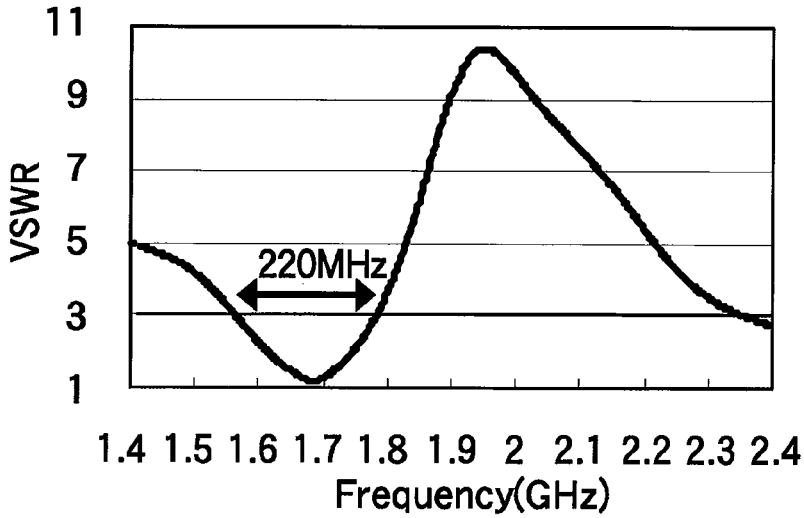

The antenna element 10A of the invention is evaluated with reference to a VSWR characteristic drawing of FIG. 3. In the VSWR characteristic drawing of the antenna element 10A of the invention, it is seen that the band width widens 20 MHz and the antenna characteristic improves as compared with the conventional antenna element of a core wire only.

Next, a modified example of the embodiment will be discussed with reference to FIGS. 1(B) and 1(C). Parts identical with those of the embodiment are denoted by the same reference numerals in the modified example and will not be discussed again.

In an antenna element 10B shown in FIG. 1(B), first conductor flat plates (also placed as bilateral symmetry and thus "third conductor flat plates) 13 protruding from a folded (dipole) antenna 11 portion of the antenna element 10B shown in FIG. 1(A) is provided in place of the first conductor flat plates 12. That is, in the first conductor flat plates 13, in addition to conductors 12A and 12B, conductors 12C and 12D are formed holding the same space d as the gap between the conductors 12A and 12B. The conductors 12A and 12C (conductors 12B and 12D) may be formed as one plate and may be electrically connected to a core wire W.

Therefore, according to the antenna element 10B, the capacitance (C) component increases and accordingly, covering of low frequencies is more enlarged and a wider band can be accomplished and in addition, flexibility of the antenna configuration and design is enlarged.

On the other hand, in an antenna element 10C shown in FIG. 1(C), each of left and right first conductor flat plates (also placed as bilateral symmetry and thus "third conductor flat plates) 14 is not divided into two parts and is formed of one plate and a space d is formed between the plate and a near core wire W1. Therefore, according to the antenna element 10C, the antenna element shape is simplified, connection work to the core wire W1 is facilitated, and the creation cost can be reduced.

(Second Embodiment)

Next, a second embodiment of the invention will be discussed. Parts identical with those of the first embodiment are denoted by the same reference numerals in the second embodiment and will not be discussed again.

Figure 4:
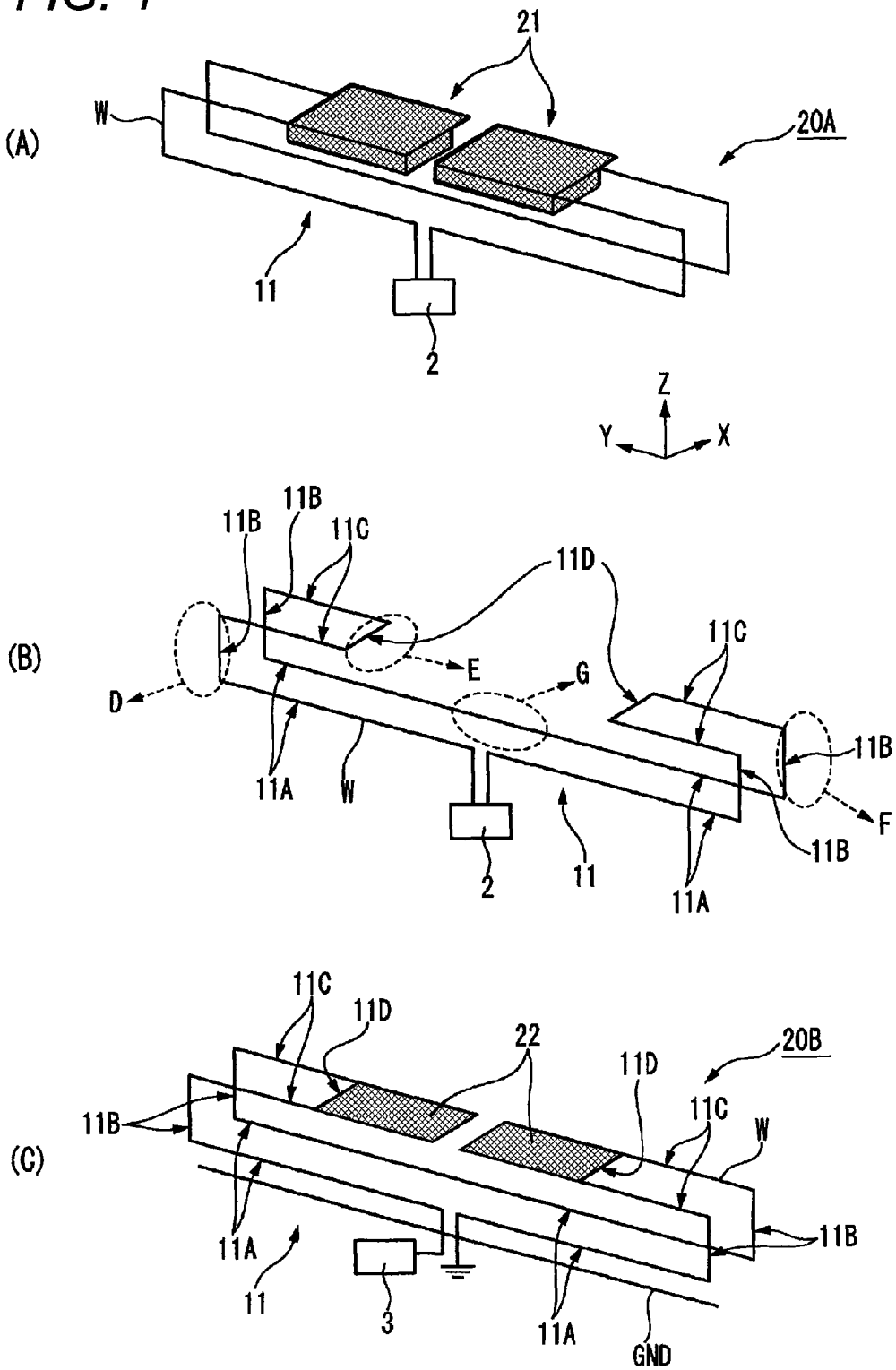
FIG. 4 shows an antenna element according to a second embodiment of the invention; (A) is a drawing to show the schematic configuration of the antenna element; (B) is a drawing to show the configuration of an antenna main body of a basic configuration; and (C) is a configuration drawing to show a modified example of (A).

FIG. 4(A) shows the schematic configuration of an antenna element 20A according to the second embodiment of the invention. In the antenna element 20A, fourth conductors 21 are provided at a midpoint of an antenna main body 11 to give an inductive reactance (L) component. If the size of each installed conductor is constant, operation is performed usually as a distribution constant where the lower the frequency, the larger the L component.

The antenna 11 has each of the fourth conductors 21 at least one part of second conductor wire part 11B, third conductor wire part 11D, second conductor wire part 11B, and second conductor wire part 11A (namely, areas D, E, F, and G of the center part of roughly angular U-shaped gap shown in FIG. 4(B)), three folded end faces provided in the center parts of A, B, and C corresponding to the balanced 2-line portions A, B, and C with one side short-circuited enclosed by the roughly angular U-shaped core wire W describe above (see FIGS. 2(B) and 2(C)).

The fourth conductor 21 is formed by working a flat conductor having an area S and is installed in the area surrounded by three conductor wires of a third conductor wire part 11C, a fourth conductor wire part 11D, and a third conductor wire part 11C.

The fourth conductors 21 of the embodiment are connected over the whole of the fourth conductor wire parts 11D of left and right folded end faces and are placed as bilateral symmetry. Each of the fourth conductors 21 of the embodiment is formed like a hollow box by bending a flat conductor having an area S and one face is projected from the antenna main body 11 to the outside (Z direction). A part of the fourth conductor 21 of the embodiment is thus projected from the antenna main body 11 to the outside, but the projection part need not necessarily be required.

Although the fourth conductor 21 of the embodiment is formed like a hollow box as described above, a second conductor flat plate 22 formed like a flat plane may be provided in place of the fourth conductor 21 as in an antenna element 20B shown in FIG. 4(C). The fourth conductor 21 of the embodiment is installed in an area E of one of folded end faces, but may be formed in any or both of areas D, F, and G (11B, 11B, and 11A) forming other folded end faces. If the fourth conductor 21 is larger, an inductive reactance component can be obtained large.

Therefore, according to the embodiment, the fourth conductor 21 having the area S is provided in the area E of the folded end face of the antenna main body 11, whereby the antenna element 20A can be provided with an inductive inductance (L) component. In the antenna element 20A of the embodiment, the area S of the fourth conductor 21 is changed, so that parameter adjustment is made and impedance adjustment is made, whereby it is made possible to adjust the antenna characteristic in a wider band.

Moreover, if a part of the fourth conductor 21 is projected and is protruded from the antenna main body 11 as in the embodiment, the area S of the fourth conductor 21 can be easily increased, so that covering of low frequencies is more enlarged. At the same time, design flexibility of the antenna configuration is also enhanced.

Figure 5:
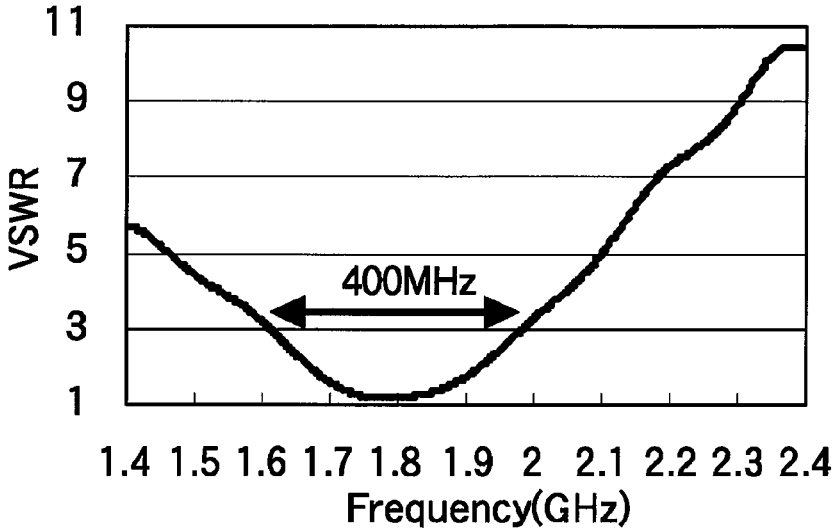
FIG. 5 is a VSWR characteristic drawing of the antenna element according to the second embodiment of the invention; (A) is a VSWR characteristic drawing of the antenna element of the invention; and (B) is a VSWR characteristic drawing of a conventional antenna element of a core wire only.
Figure 5:
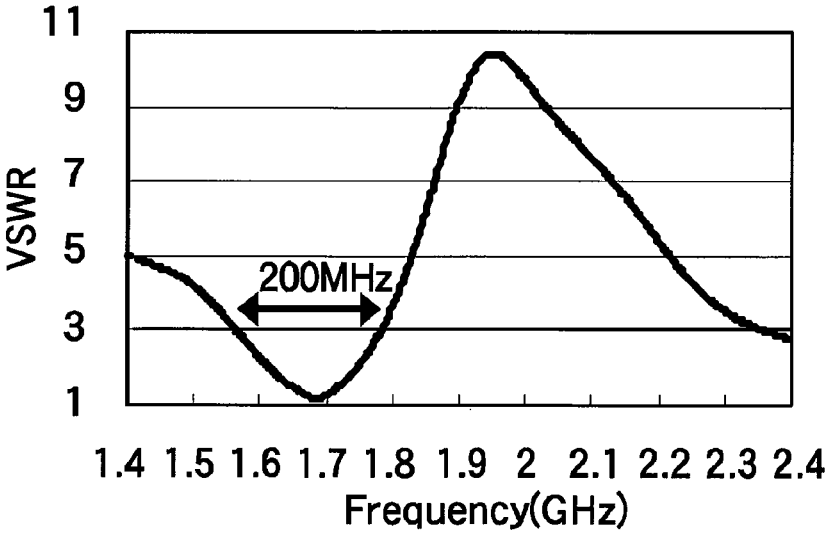

The antenna element 20A of the invention is evaluated with reference to a VSWR characteristic drawing of FIG. 5. In the VSWR characteristic drawing of the antenna element 20A of the invention, it is seen that the band width widens 200 MHz and the antenna characteristic improves as compared with the conventional antenna element of a core wire only.

(Third Embodiment)

Next, a third embodiment of the invention will be discussed. Parts identical with those of the first and second embodiments are denoted by the same reference numerals in the third embodiment and will not be discussed again.

Figure 6:
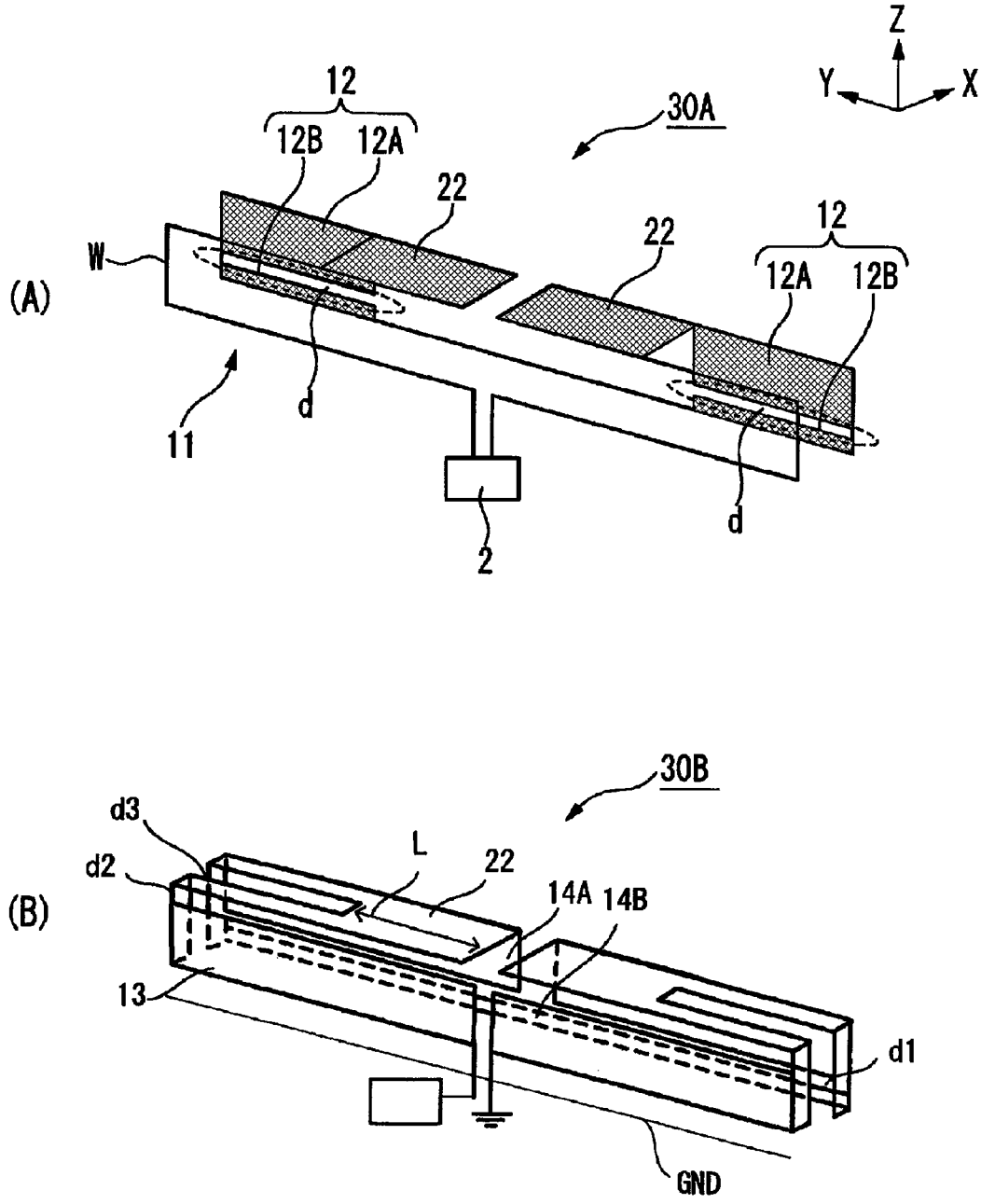
FIG. 6 shows an antenna element according to a third embodiment of the invention; (A) is a drawing to show the schematic configuration of the antenna element; and (B) is a configuration drawing to show a modified example.

FIG. 6(A) shows the schematic configuration of an antenna element 30A according to the third embodiment of the invention. In the antenna element 30A, to add both a capacitive inductance (C) component and an inductive inductance (L) component at the same time, first conductor flat plates 12 and second conductor flat plates 22 are provided at midpoint of an antenna main body 11. This means that a synergistic effect is provided according to the configuration satisfying the first embodiment and the second embodiment at the same time.

In the embodiment, the first conductor flat plate 12 is installed so as to have a space d in a balanced 2-line portion C with one side short-circuited (area C in FIG. 2(B)), but may be provided in either or both of areas A and B of the balanced 2-line portion with one side short-circuited.

As the second conductor flat plate 22, a plate shaped like a flat plane having an area S is formed over the whole of a fourth conductor wire part 11D of a folded end face (area E in FIG. 4(B)), but may be formed in any or both of areas D, F, and G of the center part of the balanced 2-line portion with one side short-circuited roughly like an angular U-shape shown in FIG. 4(B), a folded end face. At this time, if a plurality of conductor flat planes are provided and planes crossing first and second flat plates occur, the planes may be integrated into one face.

In the antenna element 30A of the embodiment, balanced feeding is performed and both end parts are connected to a balanced feeding section 2 containing a matching circuit, but if one side of the antenna element is terminated at GND and unbalanced feeding is performed from another side, a wideband characteristic is also provided. As in an antenna element 30B described later, an end part may be connected to an unbalanced feeding section 3 and GND.

Therefore, according to the embodiment, the first conductor flat plate 12 having the space d is installed in the balanced 2-line portion C with one side short-circuited and a capacitive reactance (C) component is possessed and the second conductor flat plate 22 having the area S is installed in the fourth conductor wire part 11D of a folded end face and a conductive reactance (L) component is possessed; a wider band and miniaturization of the antenna element 30A can be realized at the same time.

That is, in the antenna element 30A of the embodiment, as described above, the first conductor flat plate 12 and the second conductor flat plate 22 are provided and the captive inductance (C) component and the conductive reactance (L) component are possessed. Thus, a resonance point can be newly obtained at a low frequency as compared with the conventional antenna element not provided with the first conductor flat plate 12 or the second conductor flat plate 22 (for example, the antenna element shown in FIG. 2(B)). Consequently, if the antenna occupation volume is the same as that of the conventional antenna element, a lower frequency than that of the conventional antenna element can be covered. That is, for a resonance frequency similar to that of the conventional antenna element, a smaller antenna configuration is made possible.

Figure 7:
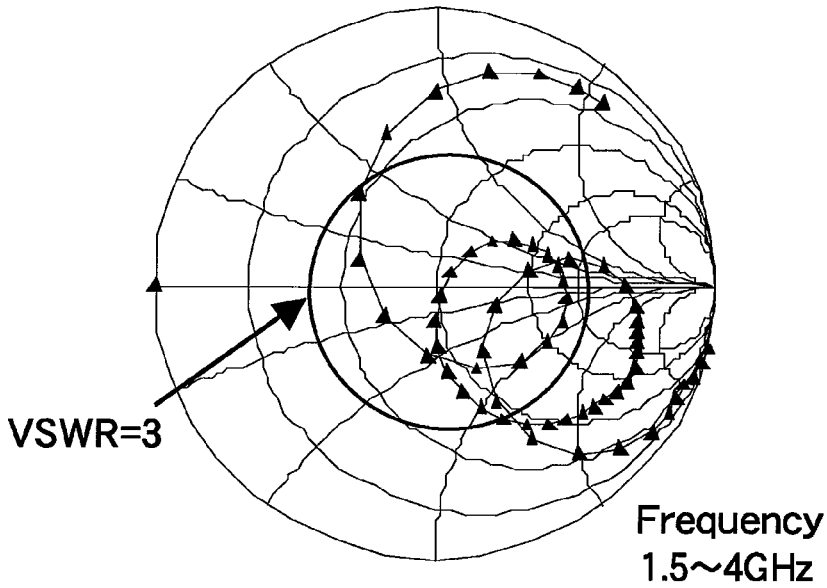
FIG. 7 is a drawing to show the reflection characteristic of the antenna element according to the third embodiment of the invention; (A) is a Smith chart to show the reflection characteristic of the antenna element of the invention; and (B) is a Smith chart to show the reflection characteristic of a conventional antenna element of a core wire only.
Figure 7:
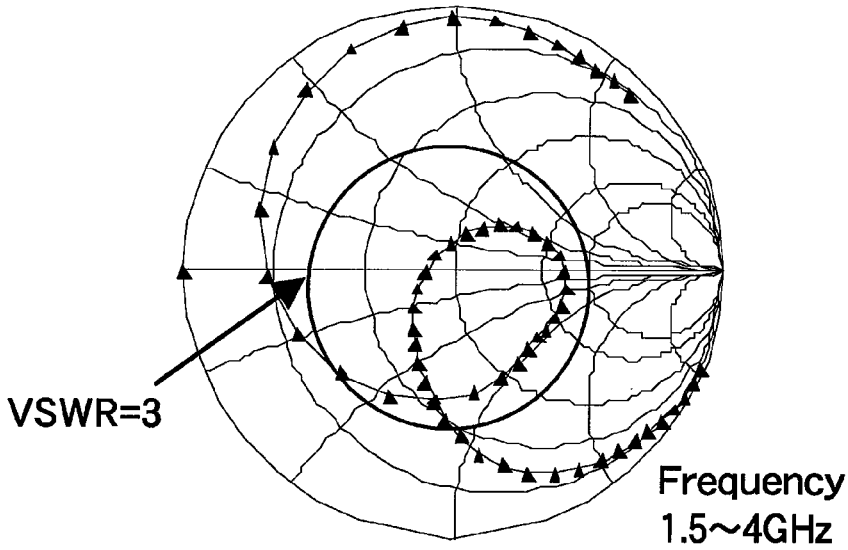

FIG. 7 shows the reflection characteristic when balanced feeding is performed for the antenna. One resonance (see FIG. 7(B)) is obtained with the conventional antenna element of a core wire only; however, according to the embodiment, two resonances (see FIG. 7(A)) can be obtained at close frequency band and thus it is made possible to make a wider band as compared with the conventional antenna element by adjustment of a matching circuit. For this operation, if the feeding system is unbalanced feeding, a similar characteristic can be provided.

Figure 8:
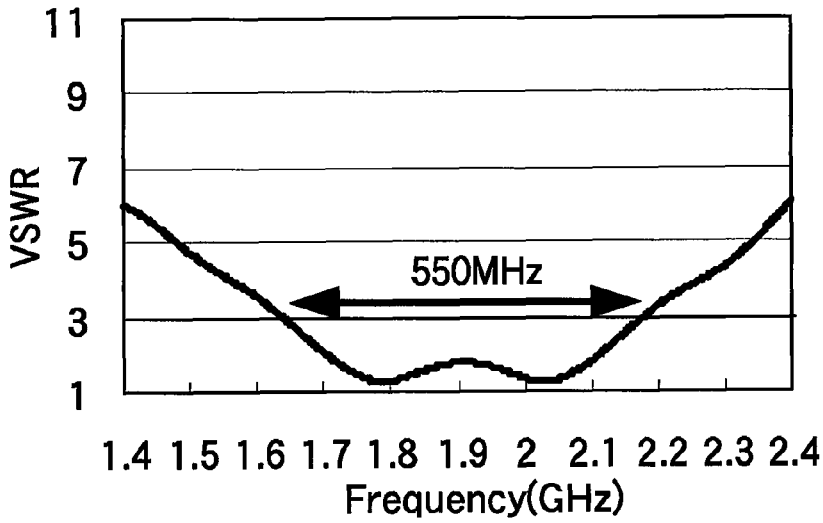
FIG. 8 is a VSWR characteristic drawing of the antenna element according to the third embodiment of the invention; (A) is a VSWR characteristic drawing of the antenna element of the invention; and (B) is a VSWR characteristic drawing of a conventional antenna element of a core wire only.
Figure 8:
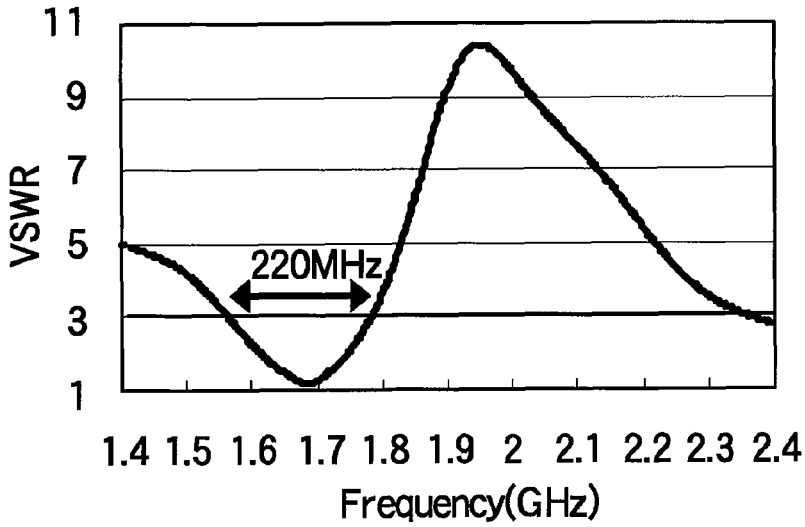

The antenna element 30A of the invention is evaluated with reference to a VSWR characteristic drawing of FIG. 8. In the VSWR characteristic drawing of the antenna element 30A of the invention, it is seen that the band width widens 330 MHz and the antenna characteristic improves as compared with the conventional antenna element of a core wire only.

Next, a modified example of the embodiment will be discussed.

FIG. 6(B) shows an antenna element 30B of a modified example of the third embodiment. In the antenna element 30B, an example of a shape wherein a plurality of conductive reactance components and a plurality of capacitive reactance components are formed in one antenna element is shown and the antenna shape is more complicated. First, a plurality of slop parts will be discussed. Conductor flat plates 14A and 14B are modified forms of the first conductor flat plate 12 and a gap of a space d is provided between the plate and an opposed core wire W; this becomes the case where slot is formed in the two angular U-shaped C parts as symmetry in FIG. 2(B). A part of the conductor flat plate 14 protrudes from the angular U-shape and the slot length is made longer.

Likewise, a conductor flat plate is also provided between other angular U-shapes A and B in FIG. 2(B), whereby different gap d2 (slot 2) and gap d3 (slot 3) are formed. An L component is further added in addition to a C component, whereby it is made possible to make impedance adjustment in the antenna element and it is made possible to provide a wideband characteristic and thus a conductor flat plate 22 having L component is further provided.

Since three capacitive reactance components are provided, the length L of the conductor flat plate 22 is adjusted long or the space of each gap (d) having the capacitive reactance component is adjusted, whereby the band characteristic is adjusted. Larger numbers of capacitive reactance components and conductive reactance components are formed in one antenna element, so that the advantage of miniaturization can also be provided large.

Using the techniques, the antenna configuration forming one or both of capacitive reactance component and conductive reactance component in the folded antenna element is made possible and a smaller and wider-band antenna can be realized.

For example, to use FIG. 6(B), in small dimensions of antenna dimensions (coordinate axes x, y, and z)=(0.01λ, 0.25λ, and 0.035λ), a wideband characteristic of ratio band=about 50% (VSWR<3) can be provided.

At this time, the antenna element is formed as a rectangular parallelepiped (hexahedron) and a low-loss dielectric material is used in the space in the antenna element, whereby the antenna element can be further miniaturized. A ceramic material, a resin material of ABS, etc., can be applied to the dielectric material.

(Fourth Embodiment)

Next, a fourth embodiment of the invention will be discussed. Parts identical with those of the first to third embodiments are denoted by the same reference numerals in the fourth embodiment and will not be discussed again.

Figure 9:
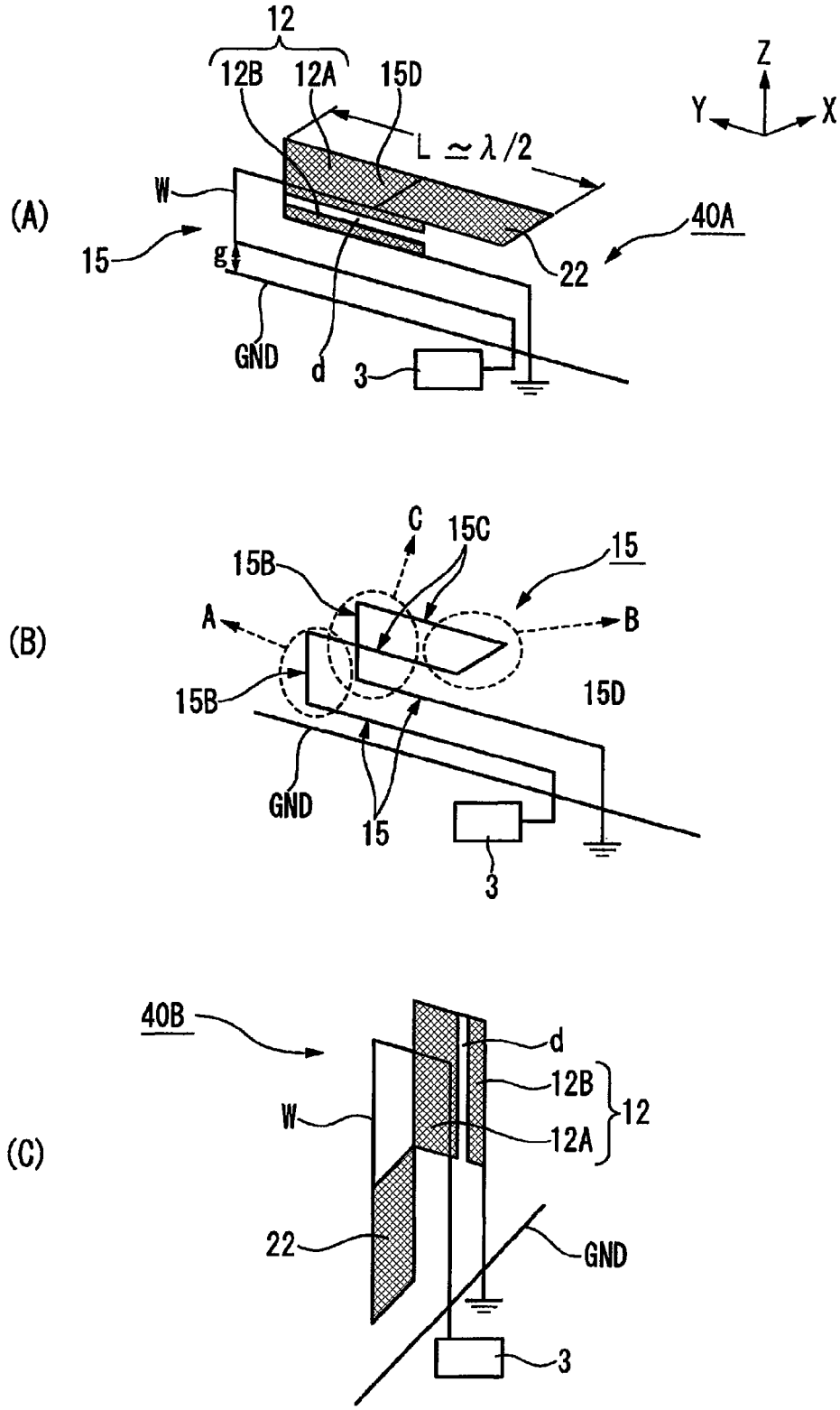
FIG. 9 shows an antenna element according to a fourth embodiment of the invention; (A) is a drawing to show the schematic configuration of the antenna element; (B) is a drawing to show the configuration of an antenna main body of a basic configuration; and (C) is a configuration drawing to show a modified example of (A).

FIG. 9(A) shows an antenna element 40A according to the fourth embodiment of the invention. The antenna element 40A basically has a folded monopole antenna (which will be hereinafter referred to as antenna main body) 15 provided by folding a quarter-wave (monopole) antenna made of a core wire (a conductor formed of a wire rod) W to two and a first conductor flat plate 12 becoming a capacitive reactance (C) component and a second conductor flat plate 22 becoming a conductive reactance (C) component, provided at midpoint of the antenna main body 15.

As shown in FIG. 9(B), the antenna main body 15 is formed by folding the core wire W with a full length L having about (λ/4) and is formed of a monopole antenna with a half point of the antenna element 30A of the third embodiment terminated at GND. Like the antenna main body 11, the antenna main body 15 includes first conductor wire part 15A to fourth conductor wire part 15D.

In the embodiment, the first conductor flat plate 12 is installed so as to have a gap of a space d in a balanced 2-line portion C with one side short-circuited (see FIG. 9(B)), but may be provided in either or both of A and B.

As the second conductor flat plate 22, a plate shaped like a flat plane having an area S is formed over the whole of the fourth conductor wire part 15D of a folded end face (see FIG. 9(B)), but may be formed in any or both of areas of other folded end faces.

Therefore, according to the embodiment, also in the antenna element 40A, the first conductor flat plate 12 and the second conductor flat plate 22 are provided and the capacitive reactance (C) component and the conductive reactance (L) component are possessed. Thus, as with the antenna element 30A of the third embodiment, one additional resonance point can be obtained as compared with the conventional antenna element. Thus, a wideband antenna characteristic can be provided.

Since the antenna element can be halved as compared with the antenna element 30A of the third embodiment, so that the antenna occupation volume can be reduced to a half and placement flexibility in a radio (wireless) device wherein the antenna is installed is enhanced.

In the invention, not only landscape orientation like the antenna element 40A of the fourth embodiment, but also portrait orientation, for example, as shown in FIG. 9(C) may be adopted.

(Fifth Embodiment)

Next, a fifth embodiment of the invention will be discussed. Parts identical with those of the first to fourth embodiments are denoted by the same reference numerals in the fifth embodiment and will not be discussed again.

Figure 10:
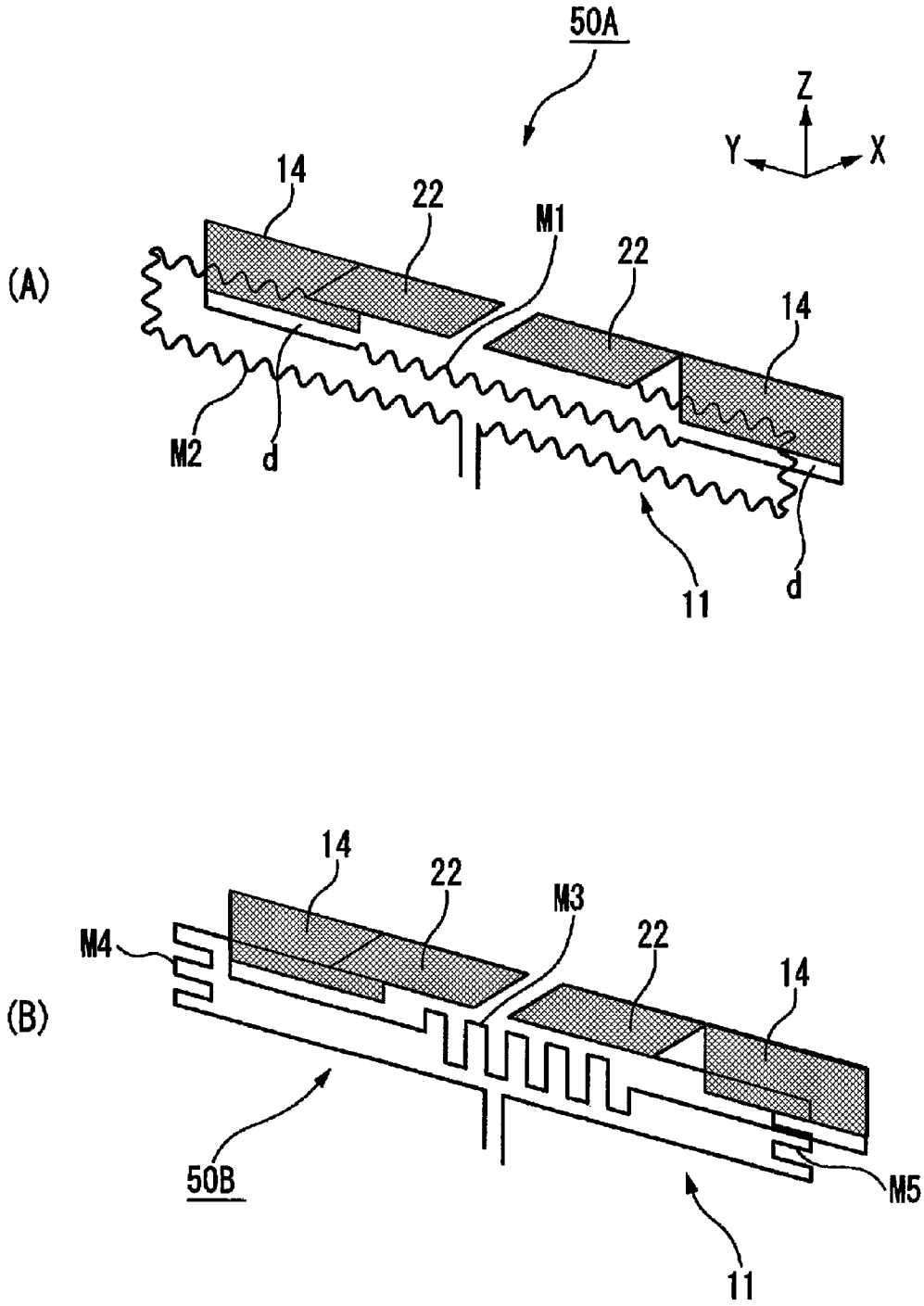
FIG. 10 shows an antenna element according to a fifth embodiment of the invention; (A) is a drawing to show the schematic configuration of the antenna element; and (B) is a configuration drawing to show a modified example.

FIG. 10 shows an antenna element 50A according to the embodiment. In the antenna element 50A, meanders M1 and M2 are formed in a portion where first conductor flat plate 14 and second conductor flat plate 22 are not provided (which will be hereinafter referred to as "conductor flat plate non-installation portion"), of a core wire W portion in the antenna element 50B shown in FIG. 10(B).

Each of the meanders M1 and M2 has a narrow pitch structure as compared with each of meanders M3 to M5 of the antenna element 50B shown in FIG. 10(B). The meanders M1 and M2 of the embodiment are formed over the whole of the conductor flat plate non-installation portion, but may be installed in a part of the portion.

Therefore, the antenna element 50A of the embodiment does not operate as a loop antenna and thus the meander configuration is useful for adjusting resonance frequency. That is, the meanders M1 and M2 of the embodiment make it possible to further cover low frequencies as the antenna characteristic.

Each of the meanders M3 to M5 of the antenna element 50B shown in FIG. 10(B) has a wider pitch width as compared with the antenna element 50A shown in FIG. 10(A) and thus the advantage of holding a wideband characteristic is expected.

(Sixth Embodiment)

Next, a sixth embodiment of the invention will be discussed. Parts identical with those of the first to fifth embodiments are denoted by the same reference numerals in the sixth embodiment and will not be discussed again.

Figure 11:
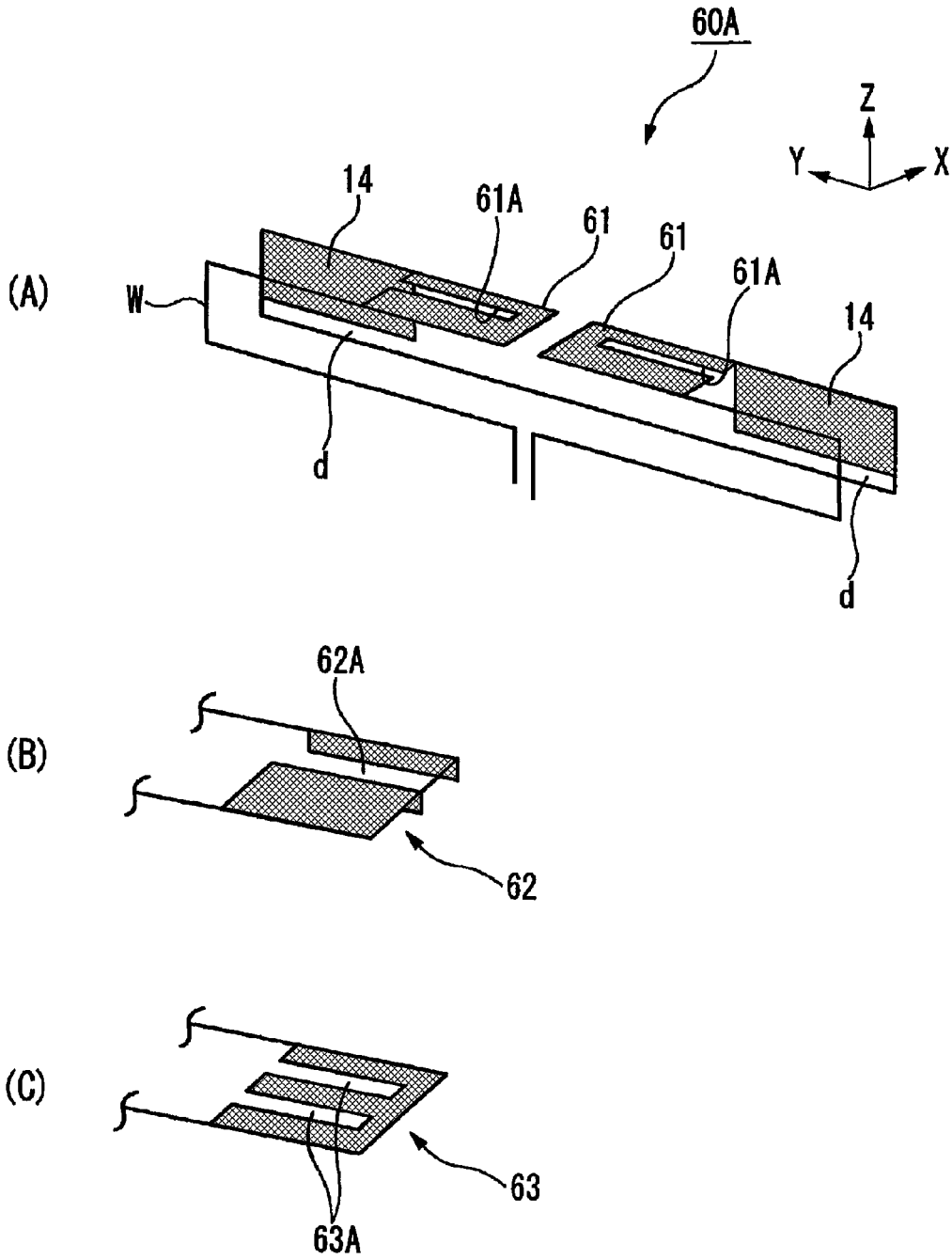
FIG. 11 shows an antenna element according to a sixth embodiment of the invention; (A) is a drawing to show the schematic configuration of the antenna element; (B) is a drawing to show the main part of a modified example; and (C) is a drawing to show the main part of another modified example.
Figure 12:
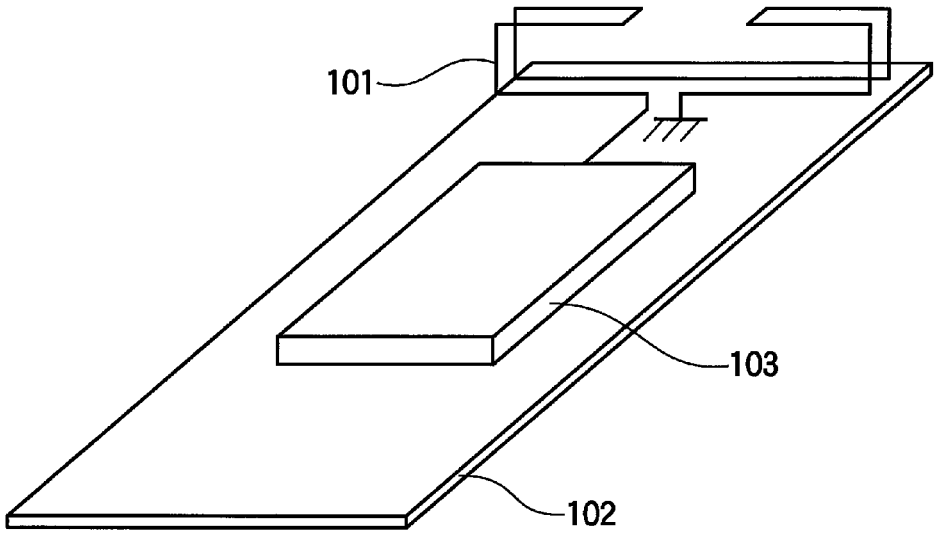
FIG. 12 is a drawing to show the schematic configuration of a conventional antenna element.
Figure 13:
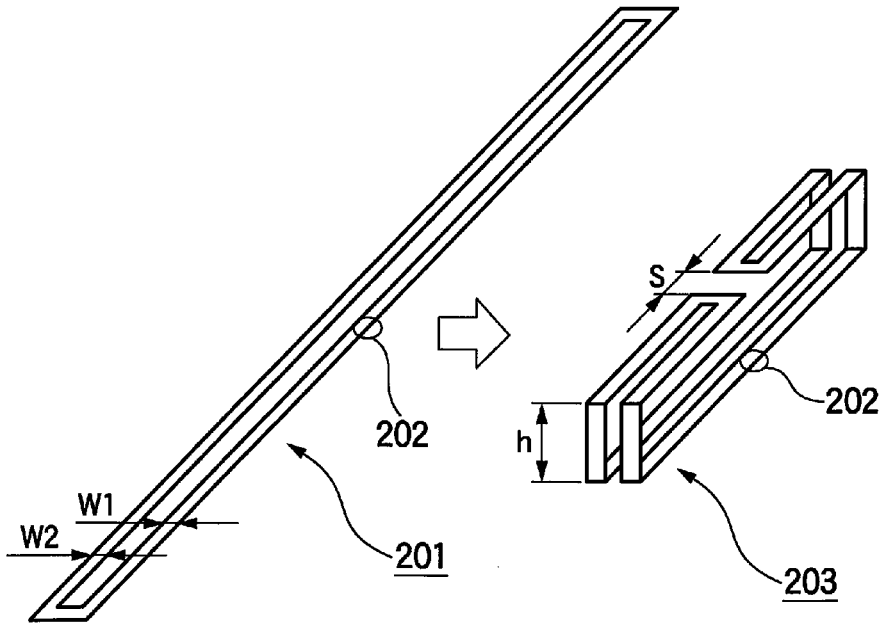
FIG. 13 is a drawing to show the schematic configuration of a conventional different antenna element.
Figure 14:
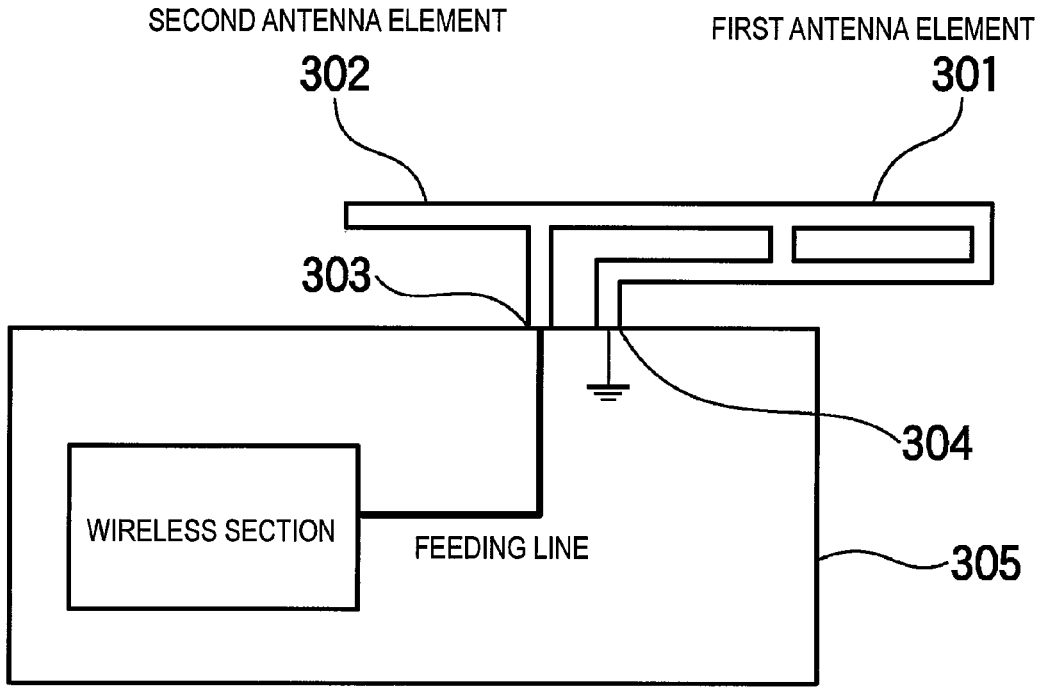
FIG. 14 is a drawing to show the schematic configuration of conventional further different antenna elements.

In FIG. 11, an antenna element 60A according to the embodiment has first conductor flat plates 14 similar to those of the antenna element 30B shown in FIG. 6(B), but second conductor flat plates 61 each with a slot 61A cut are used in place of the second conductor flat plates 22.

The slot 61A of the second conductor flat plate 61 is not limited to a plane shape; for example, it may have a structure wherein a slot 62A is bent as a second conductor flat plate 62 as shown in FIG. 11(B). It may have a structure wherein a plurality of slots 63A are cut as a second conductor flat plate 63 as shown in FIG. 11(C). Further, although not shown, a meander may be provided together with such a second conductor flat plate with a slot cut. If the slot range is taken too wide, an inductance component formed of an area S lessens.

Therefore, according to the embodiment, the second conductor flat plates 61 provided for obtaining a conductive reactance (L) component are provided each with the slot 61A, whereby miniaturization of a folded antenna operating at about 1λ is made possible. That is, the slot 61A is provided, whereby the length of one side of the conductor flat plate 61 is extended and the advantage that the electric length of an electric current flowing through the slot surface is seen substantially long can be provided. The second conductor flat plate 61 is provided with a capacitance component and double advantage can be expected. Therefore, as a whole, the effective length of the antenna element 60A becomes long and it is made possible to cover low frequencies.

Therefore, it is useful for adjusting resonance frequency as with the case where meanders are provided.

While the invention has been described in detail with reference to the specific embodiments, it will be obvious to those skilled in the art that various changes and modifications can be made without departing from the spirit and the scope of the invention.

Industrial Applicability

The invention makes it possible to provide a conductive reactance component and/or a capacitive reactance component in the folded antenna element according to the simple configuration, so that the invention has the advantage that miniaturization can be realized while the wideband characteristic is held, and the invention is useful for a small radio device, etc., of a mobile wireless terminal, etc.

The invention claimed is

1. A double folded antenna element having a rectangular parallelepiped in outer shape and formed by bending two element tips of a folded dipole antenna including balanced lines having both ends short-circuited with a predetermined space in a vertical direction and a horizontal direction as bilateral symmetry, comprising:

a slot provided by adopting at least one of both two parallel end elements among three adjacent elements having a U-shape in elements making up the double folded antenna element as a conductor face; and conducted faces symmetrically provided in double folded antenna element, and provided on at least of a center element among the three adjacent elements having the U-shape in the elements making up the double folded antenna element.

2. The double folded antenna element according to claim 1, wherein the balanced lines with the predetermined space have a predetermined thickness.

3. The antenna element according to claim 1, wherein a plurality of slots are provided, each of which is provided by adopting at least one of both two parallel end elements among the three adjacent elements having the U-shape in the elements making up the double folded antenna element as the conductor face, the double folded antenna element having the rectangular parallelepiped in outer shape, the double folded antenna element, further comprising:

two slots which are symmetrically provided in a first face of the rectangular parallelepiped forming the outer shape of the double folded antenna element;

two slots which are symmetrically provided in a second face of the rectangular parallelepiped forming the outer shape of the double folded antenna element, the second face is parallel to the first face;

two slots which are symmetrically provided in a third face of the rectangular parallelepiped forming the outer shape of the double folded antenna element, the third face is perpendicular to the first face and the second face; and conductor faces symmetrically provided in the double folded antenna element, and provided on at least of a center element among three adjacent elements having the U-shape in the elements making up the double folded antenna element.

4. The double folded antenna element according to claim 1, wherein at least one part of the conductive face is protruded outward from the rectangular parallelepiped forming the outer shape of the double folded antenna element.

5. The double folded antenna element according to claim 1, wherein at least one part of the conductive face is folded to other face from a face of the rectangular parallelepiped forming the outer shape of the double folded antenna element where the other part of the conductive face is provided.

6. The double folded antenna element according to claim 1, wherein an element having no conductive face in the elements making up the double folded antenna element has a meander shape.

7. The double folded antenna element according to claim 1, wherein at least one part of the conductive face is folded into the inside of the rectangular parallelepiped from a face of the rectangular parallelepiped forming the outer shape of the double folded antenna element where the other part of the conductive face is provided.

8. The double folded antenna element according to claim 1, wherein the double folded antenna element is subjected to unbalanced feeding.

9. The double folded antenna element according to claim 1, wherein the double folded antenna element is subjected to balanced feeding.

10. A mobile radio device having the double folded antenna element according to claim 1.

* * * * *